United States Patent [19]

Rondini

[11] Patent Number: 5,052,131

[45] Date of Patent: Oct. 1, 1991

[54] STRAPPED FOOTWEAR WITH DECORATIVE LIGHTING

[76] Inventor: Paul Rondini, 2804 East West Hwy., Chevy Chase, Md. 20815

[21] Appl. No.: 426,774

[22] Filed: Oct. 26, 1989

[51] Int. Cl.[5] ..... A43B 3/00; A43B 7/04; F21V 33/00

[52] U.S. Cl. ..... 36/137; 36/11.5; 362/103

[58] Field of Search ..... 36/137, 2.6, 139, 11.5; 362/103

[56] References Cited

U.S. PATENT DOCUMENTS

| | | | |
|---|---|---|---|
| 1,756,505 | 4/1930 | Ballou . | |
| 2,557,663 | 6/1951 | Knode | 362/103 |
| 2,931,893 | 4/1960 | Arias et al. | 36/137 |
| 3,031,561 | 3/1963 | Taicher . | |
| 3,153,745 | 10/1964 | Gurian et al. | 362/103 |
| 3,564,232 | 2/1971 | Euerbe | 36/137 |
| 3,678,604 | 7/1972 | Levine . | |
| 3,800,133 | 3/1974 | Duval | 36/137 |
| 4,020,572 | 5/1977 | Chiaramonte, Jr. | 36/137 |
| 4,112,601 | 9/1978 | Chiaramonte, Jr. | 36/137 |
| 4,130,951 | 12/1978 | Powell | 36/137 |
| 4,158,922 | 6/1979 | Dana, III . | |
| 4,253,253 | 3/1981 | McCormick | 36/137 |
| 4,581,687 | 4/1986 | Nakanishi . | |
| 4,839,777 | 6/1989 | Janko et al. | 362/103 |
| 4,848,009 | 7/1989 | Rodgers | 36/137 |

FOREIGN PATENT DOCUMENTS

| | | | |
|---|---|---|---|
| 0121026 | 10/1984 | European Pat. Off. | 36/137 |

*Primary Examiner*—Steven N. Meyers
*Attorney, Agent, or Firm*—Breneman & Georges

[57] ABSTRACT

Footwear having a combination strap and decorative lighting fully encased in transparent tubing providing multifunctional footwear suitable for a variety of occasions including leisure and night clubs having a battery, lights encased in a transparent tubing connecting to a battery timed switch for flashing the lights and battery compartment located in the sole of the sandal in a compartment which is closed by a fastener and means for opening and closing the circuit. The combination pliable strap for fixing the foot to the footwear and decorative lighting cover can be employed in a variety of configurations to construct a wide diversity of footwear constructed in accordance with the invention.

21 Claims, 4 Drawing Sheets

Fig. 1
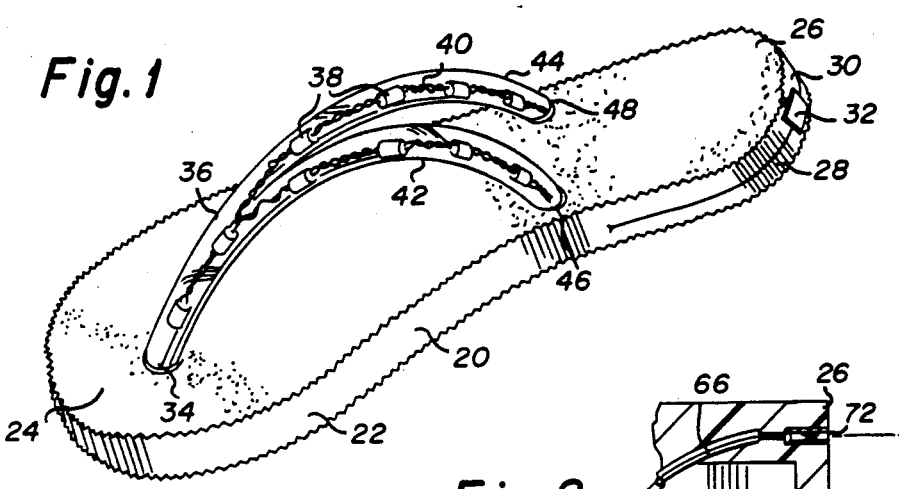
Fig. 2
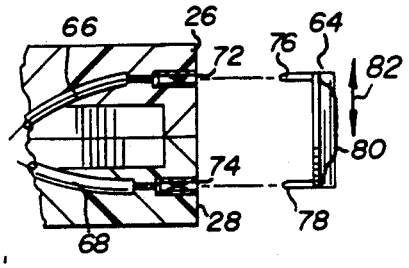
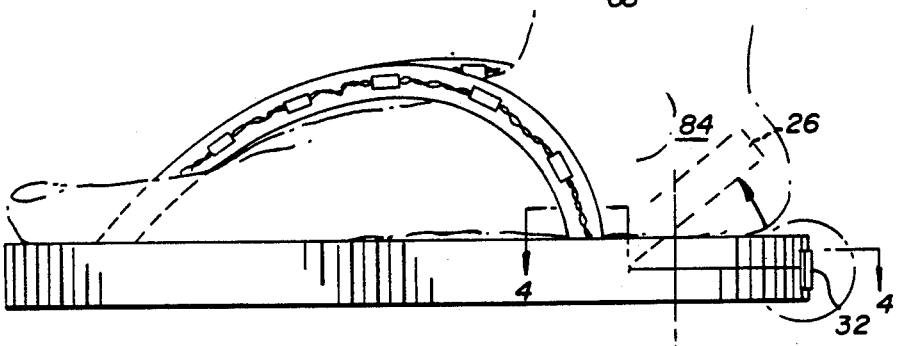
Fig. 3
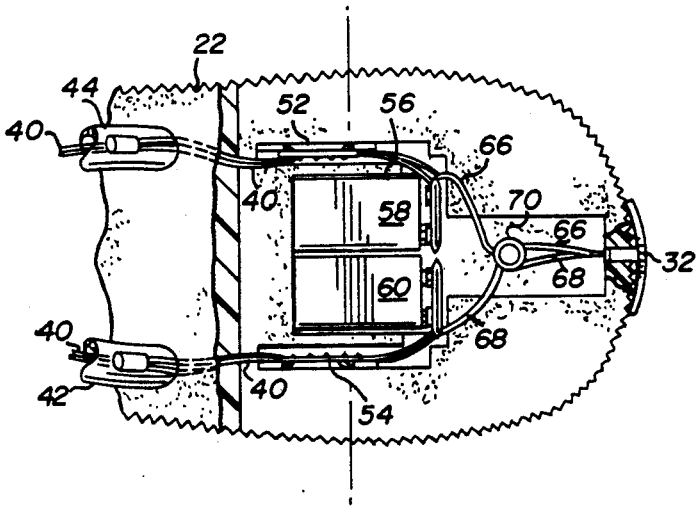
Fig. 4

Fig. 5
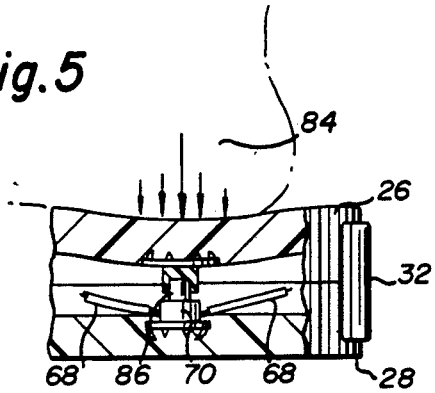
Fig. 6
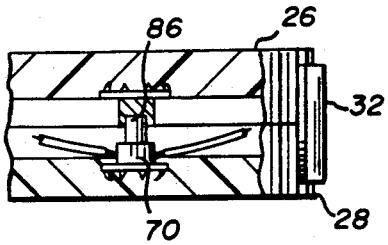
Fig. 7
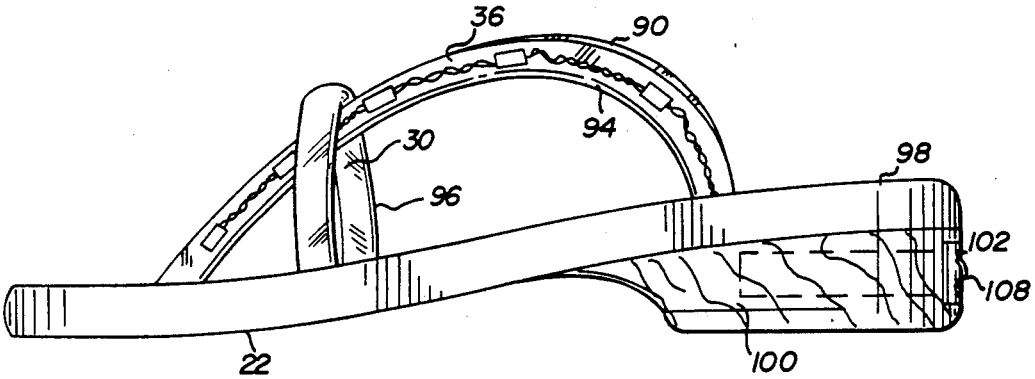
Fig. 8
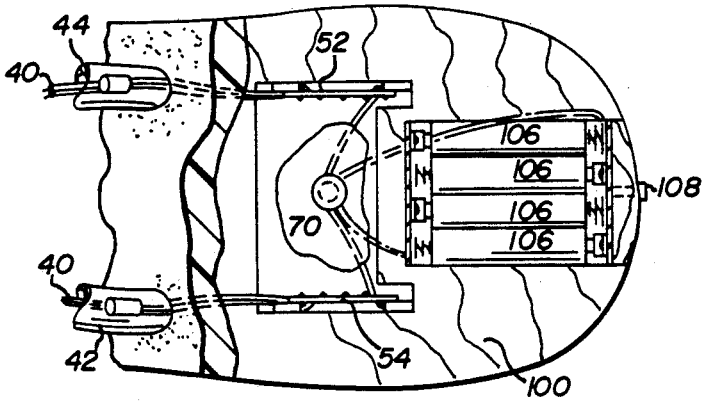
Fig. 9
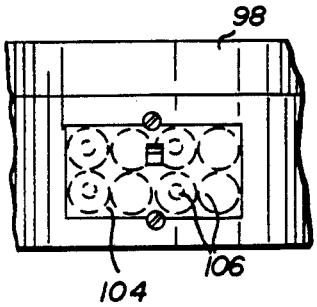
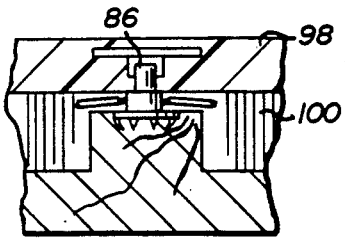
Fig. 10

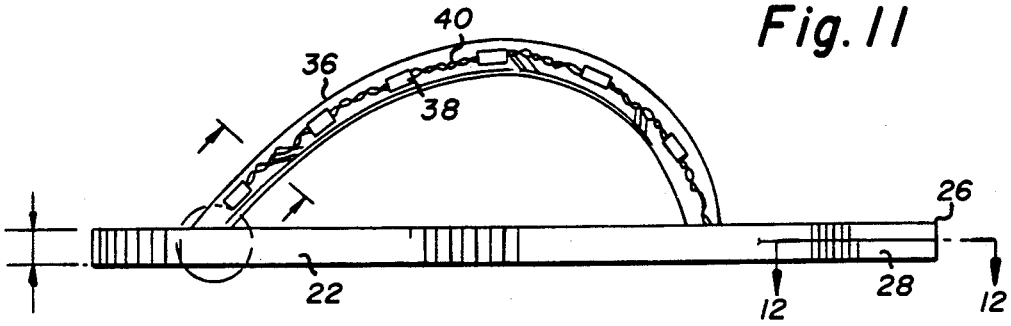
Fig. 11
Fig. 12
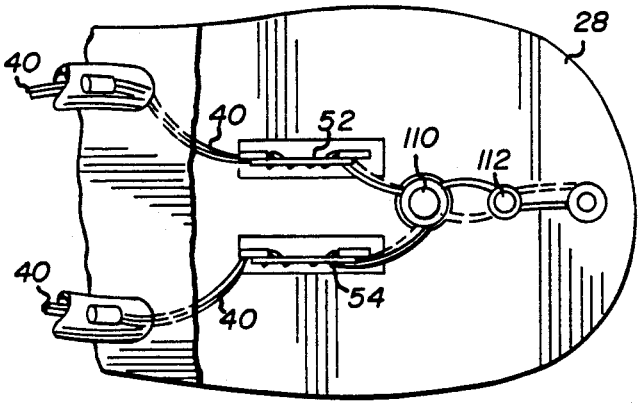
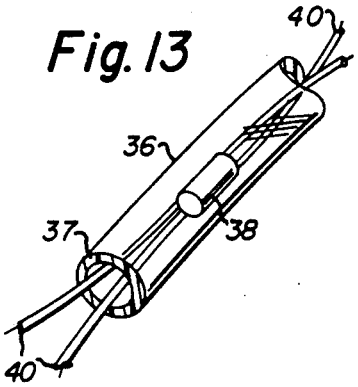
Fig. 13
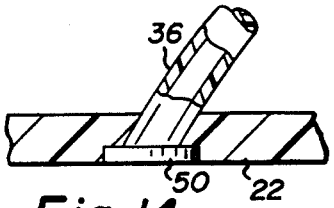
Fig. 14
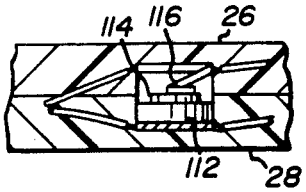
Fig. 15
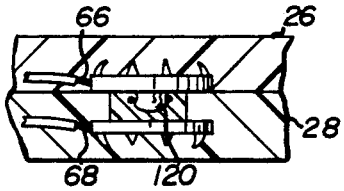
Fig. 16
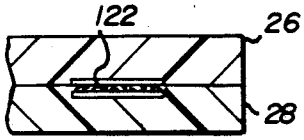
Fig. 17

STRAPPED FOOTWEAR WITH DECORATIVE LIGHTING

BACKGROUND OF THE INVENTION

1. Field of the Invention

The present invention pertains to decorative lighted footwear having straps that is of the type that is worn at the beach or for leisure which straps are formed from a transparent or translucent tubing containing decorative flashing lights fully encased in the strap and connected to the sole of the footwear. More particularly the invention pertains to comfortable sandals and footwear having straps that are traditionally worn for leisure that are decorated with flashing lights totally encased in tubing forming the straps of the sandal that converts such footwear into a high fashion footwear that can be worn at night to nightclubs and discos. The footwear of the invention are multi-functional footwear recognized not only for comfort and leisure but also for high fashion night life when the totally encased flashing lights are illuminated. The integrity of the light system is preserved by fully encasing the light sources in a transparent protective tubing which functions as straps and lighted decoration for the footwear that encloses the electrical component in the layers of the heel of the footwear.

2. Description of the Prior Art

The prior art includes a variety of sandals, shoes and other articles of footwear that include a number of different straps and tying arrangements for fastening the footwear to the foot. Much of this prior art is irrelevant since it does not include lights or flashing systems for a combination of illuminating the footwear and fixing the footwear to the foot. Prior art patents representative of sandal fastening systems are Levine U.S. Pat. No. 3,678,604 and Ballou U.S. Pat. No. 1,756,505. These patents are not as relevant as the prior art pertaining to the ordinary thong or sandal which utilizes the spaces between the toes together with the arched straps that go from the space between the toe to a position in front of the heel and is fastened to the sole of the sandal. While this prior art is directly relevant to the invention it does not teach or suggest the combination of the invention of a combined strap for attaching the footwear to the foot and providing a decorative flashing light or illuminated display for converting the ordinary thong or sandal into multi-functional footwear suitable for wear in the shower or beach and for nightclubs, discos and party footwear. Many examples of traditional party footwear are uncomfortable whereas more comfortable sandal or thong has not been dressy enough to wear to nightclubs and discos. The present invention unlike the prior art transform the ordinary sandal into a high fashion night life sandal that can be worn for both leisure and to discos and nightclubs.

Other forms of footwear in the prior art provide lighting and flashing light displays as is represented by Rodgers U.S. Pat. No. 4,848,009. This and other prior art patents cited in Rodgers pertains to footwear having constant or intermittent flashing lighting which unlike the present invention does not fully encase and protect the lighting and does not employ a combination of foot restraining strap and decorative lighting display. The multi-functional strap serves to both fix the footwear to the foot and provide a decorative illuminated display to provide an environmentally and water resistant protective covering to the footwear. The prior art flashing footwear furthermore unlike the present invention is generally expensive to produce since the decoration is not placed in the straps and does not protect the electrical lighting display from the environment by fully encasing the lighting and wiring in a water resistant system for protecting the lighting or circuitry from the environment. The prior art footwear in addition has not been designed for multi-functional use and does not provide a comfortable, desirable article of footwear that can be utilized both for beach, shower and night life environments.

The configuration of the novel footwear of the present invention allows the combination strap and decorative display to be applied to comfortable sandals or thongs which converts the comfortable sandal or thong into a multi-functional and multi-purpose article of footwear that can be worn not only on the beach or in the shower but also can be worn to nightclubs and discos by providing an illuminated flashing sandal. The novel sandal of the invention employs a hollow rounded, oval or rectangular shaped translucent or transparent tubing forming a footwear strap that covers a plurality of light emitting diodes (LED) which form the straps. As such the sandals of the present invention are inexpensive to produce and effectively protect the LEDs or lights while increasing the effectiveness of the light display and providing a comfortable multi-functional article of footwear that is comfortable at the beach, in the shower or in a nightclub or disco.

SUMMARY OF THE INVENTION

The disadvantages and limitations of prior art footwear are obviated by the present invention which utilizes a combination foot engaging strap and decorative illuminated display as is found in the familiar comfortable sandal and strap arrangement which fully encases a plurality of lights in a translucent circular, oval or flat shaped strap. The forms of strapped footwear contemplated by the present invention include strapped thongs which engage the foot in between the spaces in the toes and arch over the sides of the foot to a location between the heel and the toe of the sole. The multi-purpose footwear of the invention is equally at home at the beach or in the shower since the lighting, circuitry and battery can be entirely encased in the rubber sole and plastic translucent tubing to protect the lighting system from water and moisture but also the environment while assisting in the brightness of the light display when the lighting system is activated at night at discos or in nightclubs.

The invention utilizes a combination of the fully encased lighting in the strap members which in the preferred embodiment utilizes a plurality of light emitting diodes (LED) located inside the fully enclosed tubing which forms the straps of the sandal. The LED and wire connecting the LED in the fully encased tubing in the application to thongs extends from the two points of attachment at or near the heel of the shoe to the toe area and is connected to a battery source located in a water resistant compartment formed in the rubber sole at or near the heel of the thong or sandal. The heel of the sandal in the preferred embodiment is split and includes an opening to fully encase the power source and timer switch for flashing the lights in the tubing forming the straps of the sandals. The heel of the sandal in the preferred embodiment includes a snap or strap to open and close the heel for the replacement of the power source or battery which may further include a switch for connecting the circuit to the power source or battery.

The fully encased LEDs, lights, glass fibers or other illuminating materials within the transparent plastic tubing seals the lights from the environment while protecting the lighting, wiring and other delicate electrical components from exposure to water, sand and other potentially damaging abrasives while augmenting the optical display of the illuminated lights. The illuminated lights within the tubing can be continuous or flashing and can be turned on and off with a switch to save the life of the power source. The fully encased and enclosed electrical system is water resistant and allows the sandal or slipper to be worn in the shower, on the beach and in nightclubs to provide a multi-purpose comfortable and casual sandal that is at home on the beach or in the nightclub.

The translucent or transparent tubes that serve as both straps and decoration to protect the lighting display and wires connecting the LEDs or other illuminating devices can be circular, oval, flat or some combination thereof. The translucent or transparent plastic tubes may be tinted to further provide variation and color combinations for the lights, LEDs, glass fibers or flashing variants to provide a plurality of discrete points of light.

The power source for lighting or flashing the lighting display may be a 9 volt or 3 volt battery or a circular battery disposed in a compartment in the heel of the footwear which is opened by pivoting the back flap member of the footwear to obtain access to the power source compartment. The two halves of the sandal may be held together by a tab, snap, zipper, or other arrangement. The fastening device can be a combination fastener and switch for connecting the power source to the circuit. The combination closure device and circuit activation device may further include a switch so that once the sandal is closed the circuit may be opened and closed by the utilization of a switch.

These features of the invention provide a multi-functional comfortable article of footwear having a combination foot fastening strap and decorative display that protects the lighting system from the environment and water while allowing the footwear to be used on the beach or in discos or nightclubs. Moreover as a consequence of its design and construction the novel sandal of the invention may be constructed inexpensively and comfortably worn like any other thong or sandal which does not have an illumination or lighting display.

DESCRIPTION OF THE DRAWINGS

Other advantages of the invention will become apparent to those skilled in the art from the following detailed description of the invention in conjunction with the accompanying drawings in which:

FIG. 1 is a perspective view of a strapped sandal constructed in accordance with the invention;

FIG. 2 is an exploded side elevational view partly in section of the heel portion showing a combination mechanical clip and electrical connector;

FIG. 3 is a side elevational view partly in phantom illustrating the heel flap portion of the sandal housing the power source;

FIG. 4 is a sectional view of the heel portion of the sandal taken along lines 4—4 of FIG. 3 illustrating a battery compartment;

FIG. 5 is a side elevational view of an alternative embodiment of a switch arrangement for the sandal of FIG. 1;

FIG. 6 is a side elevational view of the alternative embodiment of the switch of FIG. 5 illustrating the switch in an inactive state;

FIG. 7 is an alternative embodiment of a strapped sandal constructed in accordance with the present invention having a raised rigid heel;

FIG. 8 is a top elevational view partly in section of the heel portion of the sandal of FIG. 7;

FIG. 9 is a side elevational view of a section of the sandal of FIG. 7 illustrating the battery compartment;

FIG. 10 is a side elevational view illustrating a pressure switch for connecting the circuit for the sandal of FIG. 7;

FIG. 11 is a side elevational view of a further embodiment of a strapped sandal constructed in accordance with the present invention;

FIG. 12 is a top plan view of the heel portion of the sandal taken along the lines 12—12 of FIG. 11 showing a modified battery compartment employing a switch and alternative means for joining the pivoting flap section to the sandal;

FIG. 13 is a perspective view of a section of the tubing enclosing the illuminating device and associated wiring;

FIG. 14 is a side elevational view illustrating the attachment of the combination strap and decorative lighting tubing to the sole of the sandal;

FIG. 15 is a side elevational view of a portion of the battery compartment and contact for a circular battery for the sandal of FIG. 11;

FIG. 16 is a side elevational view of a portion of the flap section of a sandal illustrating an alternative combined means for attaching the flap portion to the sandal and closing the circuit;

FIG. 17 is a side elevational view of a portion of a heel section of the sandal showing an alternative means for connecting the flap portion of the heel to the sandal.

DETAILED DESCRIPTION OF THE INVENTION

Figure 18:
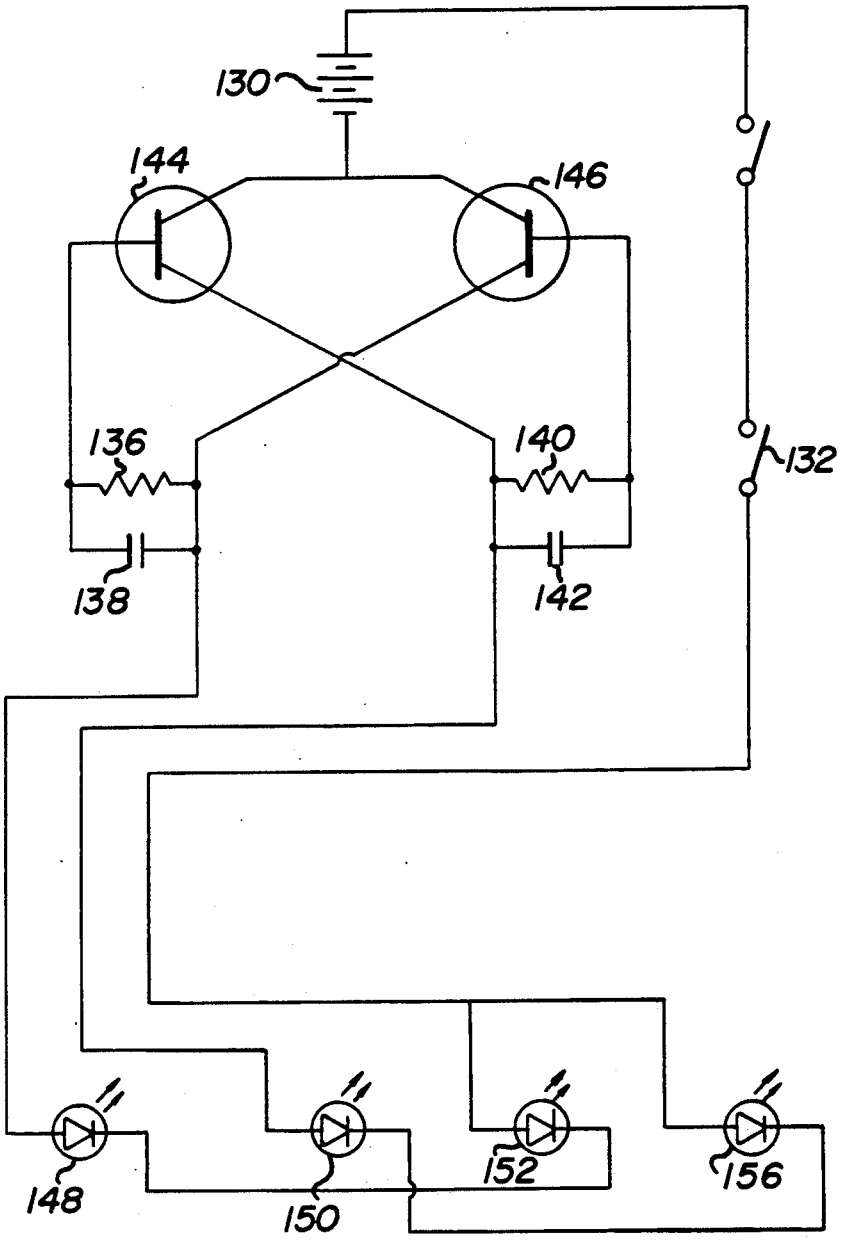
FIG. 18 is a circuit diagram of a circuit containing a timing circuit constructed in accordance with a preferred embodiment of the invention.

The invention pertains to footwear having a combination foot restraining and decorative illuminated strap of a hollow or filled construction with lights that are protected from the environment to provide a decorative article of footwear. In the preferred embodiment of the invention comfortable footwear such as sandals and thongs held to the foot with straps are transformed into night club and party footwear by employing novel illuminated decorative straps containing LED or glass fibers which are fully encased and protected from the environment and moisture to provide an inexpensive and environment resistant system for decorating footwear and sandals with lighting.

Referring now to FIG. 1 a sandal constructed in accordance with the invention such as thong 20 is illustrated having a relatively thick sole 22 of a uniform thickness of about 1 to 2 inches (2.5 to 5 cm) having a toe portion 24 and a split heel portion or flap 26. The split heel portion or flap 26 includes a ground bearing member of lower heel portion 28 and a heel bearing or upper heal portion 30 and closure 32. The thong 20 includes a well known anchor hole 34 to anchor the combination strap and hollow or filled tube strap 36 in the sole 22. The hollow or filled tube strap 36 is filled with a plurality of lights, lighted fibers or LEDs 38 which protects the LEDs 38 and wires 40 from the environment, moisture and wear. The hollow or filled tube strap 36 is transparent or translucent and flexible and fully encases the lights, lighted fibers or LEDs 38 while providing an optically enhancing display of the lights contained in the tube while functioning as a foot restraining strap for the sandal or thong 20.

Tube strap 36 arches from the toe portion 24 and is divided into two tubes 42 and 44 which are anchored in the sole 22 through anchor holes 46 and 48 near the heel portion or flap 26 of the sole 22. The ends of the hollow or filled tube strap 36 are anchored to the sole 22 through anchor holes 34, 46 and 48 in a somewhat conventional manner. In the case of anchor hole 34 the tube strap 36 is sealed in the sole 22 by closing the end 50 (FIG. 14) in the sole 22 to seal the end of tube strap 36 in the sole 22 of the sandal or thong 20. The ends of tube strap 36 disposed through anchor holes 46 and 48 are similarly sealed in the sole 22 except that wires 40 (FIG. 4) are drawn into the sole 22 before the ends of tube strap 36 are sealed in sole 22. The ends of wires 40 are connected to a single timed switch or two timed switches 52 and 54 to provide two discrete pulsing patterns to the lights, LEDs or glass fibers disposed in tube strap 36.

Referring now to FIGS. 1–6 the thong is illustrated in relation to the battery compartment 56 and the upper heel portion 30. As heretofore indicated the LEDs 38 in the tube strap 36 are sealed from the environment and moisture while the battery compartment 56 in the preferred embodiment is also water resistant and contains one or more power sources or batteries 58, 60 connected to timed switches 52 and 54 for supplying power to illuminate the lights or LEDs contained in the tube strap 36. The power source may be single or dual 3 volt or 9 volt circular or cylindrical batteries depending upon the nature of the timed switch utilized to illuminate and flash the lights or LEDs in the tube strap 36. In the preferred embodiment an RC circuit or a timer chip is utilized to run off a 3 volt battery. One such timer switch that may be utilized is a 555 or 556 chip from Texas Instruments which can be powered by a 3 volt battery.

The battery compartment 56 is closed to provide a substantially water resistant compartment for the batteries by a closure 32 which may be simply a closure or a combination closure and switch 64 as shown in FIG. 2. In the embodiment as shown in FIG. 2 wires 66 and 68 bypass and eliminate the optional pressure switch 70 (FIGS. 4, 5 and 6 ) and connect directly with a combination mechanical interlock and electrical contact 72 and 74 which are opened and closed by a slide switch 80 which is activated by sliding the switch back and forth in the directions illustrated by arrow 82.

In the alternative embodiment as illustrated in FIG. 4 a mechanical closure 32 closes the battery compartment 56 and a pressure switch 70 is provided which can be activated by the heel portion of the foot 84 disposed in direct line with the pressure switch 70 (FIG. 3 and 6) to activate the circuit when the sandal or footwear is worn. The switch can be depressed as shown in FIG. 5 by slight pressure of the foot to activate the circuit and deactivate the circuit when the sandal is not worn as shown in FIG. 6.

Referring now to FIGS. 7, 8, 9 and 10 an alternative embodiment for an article of strapped footwear constructed in accordance with the invention is illustrated. The sandal as illustrated in FIG. 7 include a sole portion 22 and two arched hollowed transparent tubes 90 and 94 and a lateral strap 96 containing lights or LEDs 38 connected by wires 40 inside the tube strap 36 which may be hollow or filled with a circular, oval or rectangular cross section. The sandal in FIG. 7 includes a heel having a resilient padded area 98 connected to a substantially rigid raised heel portion 100 made of hard rubber, wood, leather or other material. Heel portion 100 includes an access door or flap 102 for accessing a battery compartment 104 containing a power source which may consist of eight 1.5 volt batteries 106 (FIGS. 8 and 9). The flap 102 preferably contains a slide switch or button 108 for turning on the lights or LEDs or may contain the optional pressure switch 70 as previously described. The optional pressure switch 70 may be mounted in the heel portion 100 and extend up through the resilient padded area 98 for the activation of the button portion 86 on switch 70 as shown in FIG. 10 and activated in a manner similar to that described in with respect to FIGS. 4–6.

The sandal as shown in FIG. 7 may include straps in addition to the strap 96 disposed in other areas of the sandal to add decorative lighting to the sandal for wrapping up the side of the leg or at other locations on the sandal and the straps may be modified in any pattern as is recognized by those skilled in the sandal art. In all cases the straps include a plurality of lights or LEDs protected by the tube strap 36 to protect the LEDs and wire from environmental impact or water to provide a decorative sandal. The tube strap 36 shields the LEDs 38 and wires 40 from the environment as shown in FIG. 13 and may be round or oval or tinted to assist in the decorative and optical enhancement of the light sources contained within the translucent tube strap 36. The tube strap 36 may further include a malleable material for retaining the shape of the tube strap to mold the strap into specific shapes. An optional wire 37 may be placed in the tube strap 36 for providing shape retention.

Referring now to FIGS. 11, 12 and 16 a further embodiment of the invention is disclosed utilizing a thinner thong or sandal as is traditionally worn in the shower. In this embodiment of the invention a circular power source or battery 110 is employed with an alternative type switch 112 more fully illustrated in FIG. 15. As will be recognized by those skilled in the art the battery can be placed in other locations in the footwear other than the heel such as near the toe portion of the foot. These power compartments may be accessed through the foot bearing surface of the sandal and include a variety of forms of terminals and switches to preserve the battery when not in use. The thong of FIGS. 11–15 utilizes a circular battery or power source of 3–9 volts utilized to power timer switches 52 and 54 to produce a relatively flat, thin sandal or thong that is substantially water resistant. The switch 112 as shown in FIG. 15 may include a button 114 activated by the pressure of the foot through an activator 116 to illuminate the LEDs or lights encased in the tube strap 36. Alternatively, switch 112 may be eliminated by a pressure contact switch as shown in FIG. 16 which activates the circuit upon snapping or joining together flap 26 and ground bearing member 28 by a combined mechanical snap and electrical switch 120 which includes leads for wires 66 and 68 providing a combination metal snap and contact. Additionally optional fasteners 122 may be provided in other areas between the flap 26 and ground bearing member 28 to join together and hold the two in a substantially watertight configuration.

Referring now to FIGS. 1–18 a circuit diagram for activating the LEDs or lights encased in the translucent tube strap 36 is illustrated. A typical circuit for activating the flashing LEDs or lights for the footwear of the present invention is illustrated in FIG. 18. FIG. 18 is a timed switching circuit including a power source or battery 130, a switch !32 and resistor 136 and capacitor 138 forming a first RC circuit and a second RC circuit with resistor 140 and capacitor 142 a PNP transistor 144 and second NPN circuit transistor 146 which as will be recognized by those skilled in the art can be a standard 555 timer chip or a standard 556 timer chip available from Texas Instruments to provide a timed switch for selectively illuminating LEDs 148, 150, 152 and 156. The utilization of the RC circuits together with the transistors alternatively activates LEDs 148 and 152 and 150 and 156 upon the closing of switch 132 which may be conveniently provided by switch 80 or optional switch 70 in footwear constructed in accordance with the invention to provide flashing LED lights. These and similar types of circuits known to those skilled in the art to provide flashing lights including timed switches and timer chips may be utilized to provide blinking, flashing lights in the combination strap and decorative lights fully encased by the transparent tubing to illuminate footwear constructed in accordance with the invention.

As will be recognized by those skilled in the art the invention has a wide range of applicability to footwear and particularly to multi-functional and multi-purpose footwear suited for casual and leisure use on the beach and later as semi-formal footwear for nightclubs, discos and party footwear. The invention may be implemented in a variety of ways utilizing a number of comfortable footwear sandals and designs by employing the novel combination foot securing strap and decorative illuminated lighting encasing light emitting devices in flexible tubing to provide straps and foot engaging designs for sandals and other types of footwear. It will further be appreciated that the present invention may be implemented in a variety of ways to suit the particular application of straps to various types of sandals and may be done inexpensively to provide lighting systems to augment the utility and adaptability of the comfortable footwear to a variety of applications. Consequently it is intended that these and other modifications and applications of the invention to a variety of footwear styles may be made within the spirit and scope of the invention as defined in the following claims.

I claim:

1. An article of decorative footwear comprising:

(a) a sole having a toe portion and a heel portion;

(b) at least one water resistant decorative strap having a first end and a second end and a section therebetween having a substantially hollow cross sectional configuration composed of a translucent or transparent non electrically conductive plastic material for positioning or securing the footwear to the foot;

(c) a plurality of LED light emitting sources encased in said substantially hollow cross sectional configuration of said decorative strap of a translucent or transparent non electrically conductive plastic material;

(d) terminals for a power source for supplying power to said plurality of LED light emitting sources;

(e) a circuit for connecting said terminals for said power source to said plurality of LED light emitting sources, a first portion of said circuit disposed in said sole and a second portion of said circuit disposed in said water resistant decorative strap of a translucent or transparent electrically non conductive plastic material;

(f) anchoring means for sealing said first end and said second end of said water resistant decorative strap and said first portion of said circuit in said sole; and (g) a switch for connecting and disconnecting said terminals to said circuit.

2. The article of decorative footwear of claim 1 further comprising a timer switch for alternatively activating said plurality of LED light emitting sources.

3. The article of decorative footwear of claim 2 wherein said timer switch is an RC circuit.

4. The article of decorative footwear of claim 2 wherein said timer switch is a timer chip.

5. The article of decorative footwear of claim 1 wherein said decorative strap is an environmentally sealed strap of a circular or oval shaped cross section.

6. The article of decorative footwear of claim 1 further comprising a flat circular battery disposed in the heel portion of said sole.

7. The article of decorative footwear of claim 1 wherein said heel portion of said sole includes a flap for separating said upper heel portion from said lower heel portion to provide access to a battery compartment.

8. The article of decorative footwear of claim 7 further comprising a fastener for fastening said upper heel portion to said lower heel portion.

9. The article of decorative footwear of claim 8 wherein said fastener for fastening said upper heel portion to said lower heel portion further comprises said switch for connecting and disconnecting said power source to said circuit.

10. The article of decorative footwear of claim 1 wherein said decorative strap of translucent or transparent electrically non conductive plastic material includes a malleable strand for imparting retention shape to said decorative strap.

11. An illuminative decorative sandal comprising:

(a) a sole having a toe portion and a heel portion said heel portion having a foot bearing surface and a ground bearing surface and a compartment for a power source disposed between said footing bearing surface and said ground bearing surface;

(b) at least one decorative strap having a first end and a second end composed of a translucent or transparent water resistant electrically non conductive plastic material for securing said sole to the foot of the wearer and protecting a circuit and a light emitting source disposed inside said decorative strap from the skin of the wearer and the environment;

(c) a light emitting source providing a plurality of discrete points of light encased inside said decorative strap of a translucent or transparent water resistant electrically non conductive plastic material;

(d) anchoring means for sealing said first end and said second end of said decorative strap in said sole;

(d) a power source disposed in said heel portion of said sole for supplying power to said light emitting source;

(f) a circuit for connecting said light emitting source to said power source; and (g) a switch disposed in said heel portion of said sole for connecting and disconnecting said power source to said circuit.

12. The illuminative decorative sandal of claim 11 wherein said light emitting source is intermittently activated to provide a flashing display for said plurality of discrete points of light.

13. The illuminative decorative sandal of claim 12 wherein said switch in said heel portion of said sole functions as a mechanical closure for opening and closing said compartment for said power source.

14. The illuminative decorative sandal of claim 12 having a plurality of decorative straps containing a plurality of light emitting sources for independently flashing each of said plurality of discrete points of light.

15. The illuminative decorative sandal of claim 14 wherein said plurality of straps are of a oval, circular or rectangular hollow cross section tubular material.

16. The illuminative decorative sandal of claim 15 wherein said plurality of straps extend from the toe portion of said sandal rearward toward said heel portion of said sole.

17. The illuminative decorative sandal of claim 15 wherein at least one of said plurality of straps extend laterally across the toe portion of said sole.

18. A decorative strapped sandal comprising:

(a) a sole having a toe portion and a heel portion said heel portion having a heel bearing surface and a ground bearing surface and a compartment disposed intermediate said heel bearing surface and said ground bearing surface for receiving a power source;

(b) a first substantially hollow translucent or transparent water resistant electrically non conductive decorative strap having a first end and a second end anchored and sealed in said sole at or near said toe portion and extending back toward said heel portion and anchored to seal said first hollow translucent or transparent water resistant electrically non conductive decorative strap in said sole intermediate said heel portion and said toe portion;

(c) a second substantially hollow translucent or transparent water resistant electrically non conductive decorative strap joining said first hollow translucent or transparent water resistant electrically non conductive decorative strap at or near said toe portion and extending back toward said heel portion and anchored to seal said second hollow translucent or transparent water resistant electrically non conductive decorative strap in said sole intermediate said heel portion and said toe portion;

(d) at least one light emitting source encased inside said first hollow translucent or transparent water resistant electrically non conductive decorative strap and said second hollow translucent or transparent water resistant electrically non conductive decorative strap;

(e) a circuit for connecting said at least one light emitting source to terminals for a power source disposed in said heel portion of said sole; and (f) a combination switch and mechanical closure for closing said heel bearing surface to said ground bearing surface of said sole and for opening and closing said compartment for receiving a power source and connecting said circuit to said power source.

19. The decorative strapped sandal of claim 18 further comprising a timer circuit for alternatively activating said at least one light emitting source.

20. The decorative strapped sandal of claim 18 wherein said compartment for said power source is water resistant.

21. The decorative strapped sandal of claim 18 further comprising a circular battery power source.

* * * * *